US006396769B1

(12) United States Patent
Polany

(10) Patent No.: US 6,396,769 B1
(45) Date of Patent: May 28, 2002

(54) SYSTEM FOR HOUSING A PERSONAL S.C.U.B.A DIVING AUDIO SYSTEM

(76) Inventor: Rany Polany, 4620 Alice St., San Diego, CA (US) 92115

( * ) Notice: Subject to any disclaimer, the term of this patent is extended or adjusted under 35 U.S.C. 154(b) by 0 days.

(21) Appl. No.: 09/411,983

(22) Filed: Oct. 4, 1999

(51) Int. Cl.[7] ..... B65D 81/00
(52) U.S. Cl. ..... 367/131
(58) Field of Search ..... 367/131, 132, 367/141, 165, 173, 188

(56) References Cited

U.S. PATENT DOCUMENTS

| | | | | | |
|---|---|---|---|---|---|
| 4,281,343 | A | * | 7/1981 | Monteiro | 348/373 |
| 4,336,537 | A | | 6/1982 | Strickland | 340/850 |
| 4,381,144 | A | * | 4/1983 | Breslau | 367/131 |
| 4,456,797 | A | * | 6/1984 | Olsen | 367/132 |
| 4,465,189 | A | | 8/1984 | Molzan | 206/524.8 |
| D278,761 | S | | 5/1985 | Fuller | D2/381 |
| 4,562,590 | A | * | 12/1985 | DeLage | 381/189 |
| 4,584,718 | A | * | 4/1986 | Fuller | 455/351 |
| 4,682,363 | A | * | 7/1987 | Goldfarb et al. | 381/189 |
| 4,683,587 | A | * | 7/1987 | Silverman | 381/311 |
| 4,727,599 | A | * | 2/1988 | Rappaport | 455/351 |
| 4,771,299 | A | * | 9/1988 | Gell, Jr. | 396/26 |
| 4,949,806 | A | * | 8/1990 | Hofer | 181/129 |
| 5,087,934 | A | | 2/1992 | Johnson | 354/64 |
| 5,136,555 | A | | 8/1992 | Gardos | 367/132 |
| 5,239,323 | A | * | 8/1993 | Johnson | 396/27 |
| 5,258,592 | A | | 11/1993 | Nishikawa et al. | 200/302.2 |
| 5,285,894 | A | * | 2/1994 | Kamata et al. | 206/316.1 |
| 5,294,988 | A | * | 3/1994 | Wakabayashi | 396/27 |
| 5,325,139 | A | * | 6/1994 | Matsumoto | 396/27 |
| 5,337,364 | A | * | 8/1994 | Fitch | 381/151 |
| 5,386,084 | A | * | 1/1995 | Risko | 200/302.2 |
| 5,456,377 | A | * | 10/1995 | Williams, Jr. | 220/242 |
| 5,533,637 | A | | 7/1996 | Williams, Jr. | 220/3.8 |
| 5,533,737 | A | * | 7/1996 | Borowski | 277/419 |
| 5,537,667 | A | * | 7/1996 | Kenning | 381/386 |
| 5,570,688 | A | | 11/1996 | Cochran et al. | 128/205.23 |
| 5,579,284 | A | * | 11/1996 | May | 367/132 |
| 5,586,176 | A | * | 12/1996 | Peck | 367/132 |
| 5,610,655 | A | | 3/1997 | Wakabayashi et al. | 348/373 |
| 5,706,251 | A | * | 1/1998 | May | 367/132 |
| 5,822,180 | A | * | 10/1998 | Deschamps | 361/627 |
| 5,825,718 | A | | 10/1998 | Ueki et al. | 367/132 |
| 5,889,730 | A | | 3/1999 | May | 367/132 |

* cited by examiner

*Primary Examiner*—Daniel T. Pihulic
(74) *Attorney, Agent, or Firm*—Knobbe, Martens Olson & Bear, LLP

(57) ABSTRACT

A submersible, hydrostatic pressure tolerant enclosure is presented for a portable radio, tape recorder/player, minidisk player, mp3 player, cellular phone, or other devices used for projecting audio, in the form of a rigid unified membrane with a built in stereo jack adapter capable of a pressure resistant coupling to a stereo jack. Also presented is a removable rigid lid allowing for the inserting and removing of the device from the enclosure, which is comprised of recessed sealing compression o-rings and control knobs to externally manipulate the internal device. Also provided is a hydraulic coupler system adapted into the frame of the housing that contains a stereo jack adapter that connects to a submersible pressure resistant scuba mask strap speaker system. The speakers have the ability to rotate horizontally and vertically to be positioned near the ear canal or moved out of the way in case of an emergency. These speakers system also contain a device that will provide the means for regulating amplification to maintain fidelity. As a unified system, this invention safely, hydrodynamically, and economically enables a scuba diver to listen to a high fidelity audio track from a portable device while underwater in a pressurized environment.

14 Claims, 5 Drawing Sheets

SYSTEM FOR HOUSING A PERSONAL S.C.U.B.A DIVING AUDIO SYSTEM

BACKGROUND OF THE INVENTION

1. Field of the Invention

This invention relates in general to underwater pressure resistant housings, and in particular, to underwater housings that serve as portable systems for containing and delivering audio media players while scuba diving at depths exceeding atmospheric pressure.

Scuba diving has increased in popularity as a recreational hobby over the decades. Although it is a wonderfully scenic and visual activity, the added feature of audio entertainment in the form of music will greatly increase the pleasure of the activity. Currently, reliable technology does not exist that will allow a scuba diver to have a personal and portable underwater music system while scuba diving at depths exceeding atmospheric pressure.

The emergence of lightweight and diminutive portable audio players such as compact disc, minidisk, and mp3 players have become popular with sports enthusiasts who enjoy listening to music for entertainment while engaging in physical activity and sporting events. Such audio playing devices, however, as currently manufactured are not constructed to withstand being submersed and pressurized by an aquatic environment. Thus these devices cannot be used while scuba diving, which entails submersion and a pressurized environment evoked by the aquatic environment. Prior art describes methods for overcoming the limitations of surface related water activities. However, prior to the development of this invention, people have not been able to reliably, and economically, use portable electronic audio devices while engaging in submersed and pressurized activities such as free diving and scuba diving.

It is the goal of this invention to describe a system for a submersible audio housing system adapted for scuba diving. This unit is designed to function while being submersed because it can maintain a hydrostatic seal against extreme aquatic pressure. This unit will also be able to deliver audio to the users ear canal underwater via such methods as ultrasonic frequency and bone conduction methods by way of analog cables or wireless technology. This unit is portable so each diver can carry and control the unit individually and not infringe on the privacy of other divers. Finally, it is the goal of this invention to describe an apparatus that is easy to use, inexpensive, and can be easily repaired and updated.

2. Prior Art

In order to provide background information so that the invention may be completely understood and appreciated in its proper context, reference is made to a number of prior art patents and publications.

Williams (U.S. Pat. Nos. 5,456,377 and 5,533,737) defines a system for enclosing electrical outlet fixtures and serves as a method of weatherproofing power plugs. This concept of enclosing an electrical system is further adapted by enclosing complete electric devices.

Deschamps (U.S. Pat. No. 5,822,180) defines a watertight cabinet for electrical devices and components. This device is constructed from a plurality of mounting plates and is sealed internally with glue. A door is assembled to the frame, which pivots on hinges, and can be closed to make watertight seals. The structure is perforated to form a duct for passage of wiring to the internal components. Further advancements are represented in Molzan (U.S. Pat. No. 4,465,189) which describes a waterproof container. This smaller device is designed for small objects and the container is made of deformable material made to collapse around the internal equipment under environmental pressure. Risko (U.S. Pat. No. 5,386,084) defines a means of enclosing an electronic device using a flexible membrane and a battery access door. These devices are designed to effectively seal equipment containers against water and moisture. However, these structures are not designed for underwater use, especially under circumstances experienced while scuba diving. Advancements have been achieved that further develop the concept for waterproofing a case for electrical devices.

Kamata (U.S. Pat. No. 5,285,894) defines a waterproof casing suitable for housing a camera. The device uses a non-woven air-permeable fabric material to allow airflow for film advancement purpose but not water. Furthermore, other structural deficiencies prohibit this device from being a reliable mechanism for housing an electrical device while experiencing ambient pressure during scuba diving. Johnson (U.S. Pat. No. 5,239,323) defines a waterproof bag mechanism for housing a camera. This device uses a flexible membrane to house the camera which is clearly designed for environments that are wet, but not invoking environmental pressure (i.e. surfing, kayaking, boat, and other surface related wet activities). In order to deal with the pressure of the environment altering the structure of the housing and crushing the internal components, advancements have been achieved that utilize flexible membranes that have been pressurized internally.

Gell (U.S. Pat. No. 4,771,299) defines a flexible, waterproof container that can be internally pressurized. This device is complex, bulky, costly, and requires peripheral technology to pressurize the unit. In addition, it is highly susceptible to failure because of the high potential for puncture of the flexible membrane, causing the entire compartment to flood and destroy the device. To solve the problem of an expensive and puncture prone pressurized flexible membrane, rigid housing systems have been achieved.

Monterio (U.S. Pat. No. 4,281,343), Wakabayashi (U.S. Pat. No. 5,294,988), Matsumoto (U.S. Pat. No. 5,325,139), and Breslau (U.S. Pat. No. 4,381,144) describe a system using rigid material to house a video camera. Although these devices are suitable for maintaining a seal in a hydrostatic environment, they do not serve the function of a containing an audio electronic device and delivering the music to the users ear canal. The concept of rigid housing was further adapted to house audio components in wet environments.

Delage (U.S. Pat. No. 4,562,590) defines a device that will contain an entire stereo and loudspeaker system. The design is a container with a removable lid that exposes the stereo system. In this way a stereo system can be transported in a wet environment and avoid damage. Clearly, this design in not efficient for a scuba diver but rather for surface related activities that require protecting electronic devices from water. Thus far, a system for containing an audio electronic device has not been clearly described in prior art that can handle the pressurized aquatic environment experienced while scuba diving.

Hofer (U.S. Pat. No. 4,949,806) defines a headset for underwater use. This device is susceptible to easy destruction because of the ability of water and other debris in the medium to flow close to the circuitry. This device is capable of emitting a limited frequency range based on a single bone conduction speaker. The invention described henceforth describes a multiple-speaker system that emits a combined frequency range specific to an underwater environment by compensating for the water dampening effect of specific audio waves, resulting in superior fidelity. The idea is further develop by Rappaport et al (U.S. Pat. No. 4,727,599) by using a headband to contain the speakers and radio system and Kenning et al (U.S. Pat. No. 5,537,667) who describes a swimming training cap with embedded speakers.

Goldfarb (U.S. Pat. No. 4,682,363) defines an amphibious personal audio system for swimmers. A critical failure of the application of this device to scuba diving is that the earphones are inserted into the user's ears. Furthermore, the speakers are worn as a headband. Such a device will interfere with the strap of a mask, may fall off during a scuba dive, and, may only be worn without a hood because the speakers need to be inserted in the ear canals. Thus, in water temperatures that require hoods for thermal protection of the head, this device would not be functional. In addition, the structural design describes a flexible membrane that cannot withstand hydrostatic pressure. Further advancements have been achieved that utilize flexible membranes to allow for improved aquatic protection and have made it possible for audio devices function while swimming at the surface water level.

Fuller (U.S. Pat. No. 4,584,718) and Olsen (U.S. Pat. No. 4,456,797) defined a flexible membrane housings for a personal stereo and speaker system with conical type earphones which the users inserts into the ear canals to maintain a fidelity. The first concern with the application of these devices to scuba diving is that the design of conical ear plugs is not appropriate for scuba diving because the ambient pressure will force the ear plugs deep into the ear canal causing pain and damage to the ear canal. Secondly, the flexible membrane will compress around the device causing all the buttons to be pressed, and possibly implode the device. Clearly, these designs are meant for activities associated with being at the surface level. These devices are not suited for pressurized environments sustained while scuba diving but rather for surface related activities such as swimming, surfing, boating, and wind surfing. Silverman (U.S. Pat. No. 4,683,587) also defines a system for submersible headphones that is similarly inadequate for scuba diving. These devices mention forms of earphones that are not suitable for scuba diving because the pressure will push the conical ear plus speakers into the ear canal. Clearly, such designs were meant for activity on the surface of the water allowing for waterproof activity. Furthermore, the architecture and structure of the housings are flexible in nature and not suitable for the pressurized environment encountered while scuba diving.

Peck (U.S. Pat. No. 5,586,176) and May (U.S. Pat. No. 5,889,730) describe underwater communication systems that use head mounted speaker systems connected to underwater transceivers/receivers for audio communication amongst divers. These devices are not described to be coupled with a portable audio entertainment electronic device but rather for voice communication between divers.

Whatever the precise merits, features, and advantages of the above cited references, none of them achieves, or fulfills, the purposes of the present invention.

OBJECTS OF THE INVENTION

In view of the vast number of non-submersible consumer electronics which are available for audio entertainment, it is the principal object of the present invention to provide a system adapted to receive entertainment or communications devices such as CD players, mp3 players, minidisk players, tape players, laptop computers, portable cellular telephones, or other consumer electronics, whereby these devices may allow a scuba diver to safely enjoy music, while underwater, and protecting the stereo equipment from exposure to a pressured aquatic environment without changing the physical structure. This housing system is capable of being submersed to one, or more, units of absolute pressure while maintaining a hydrostatic seal against the aquatic environment.

It is also the goal of this invention to describe a submersible pressure resistant housing enclosure with arbitrarily located controls that will allow accurate and precise control of any consumer audio electronic device from the exterior, while maintaining a seal against the ambient pressure.

It is also the goal of this invention to provide an audio jack adapter built into the housing while maintaining a hydrostatic seal against one or more units of pressures absolute.

It is also the goal of this invention to describe a means of attaching a mating female audio jack adapter to the housing. The audio mechanism is snapped, and locked, onto the housing to enhance connectivity and fidelity. Audio can therefore be transmitted from the interior of the housing to the ear canals of the user while maintaining a hydrostatic seal against one or more units of pressures absolute.

A further objective is to provide a means of using analog cables with an external volume control to deliver the audio information to the speakers.

A further objective is to provide a means of using wireless transmission to deliver the audio information to the speakers.

A further objective is to describe a hydrodynamic and efficient means of orientating the headphones by attaching them to a mask strap.

It is also the goal of this invention to describe a means of receiving and projecting high fidelity audio sound via a specialized underwater headphones system while maintaining a hydrostatic seal against one or more units of pressures absolute.

A further objective is to provide for other preferred ideas that may arise from this invention.

SUMMARY OF THE INVENTION

The first embodiment ("TYPE I") described in this invention, uses audio cables connected to a strap speaker system.

In a second embodiment described in invention ("TYPE II"), a wireless transmitter is used to send the audio signals to the mask strap speaker system shown in FIGS. 3–4. A third embodiment ("TYPE III") is contemplated that describes a wireless transmitter 37 to a bone conduction regulator mouthpiece such as in the device of U.S. Pat. Nos. 5,579,284 and 5,706,251.

A fourth embodiment ("TYPE IV") also is contemplated that uses a wireless transmitter 37 to a wrist mounted bone conduction system described in U.S. Pat. No. 5,337,364. It is conceivable to integrate a wireless receiver into the patents of TYPE III and TYPE IV that will then transmit the audio to the ear canals using nerve receptors and bone conduction. While it is not the objective of this patent to create a new and novel component, it is the objective of this patent to identify such integration's and provide a claim to the idea.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Figure 1:
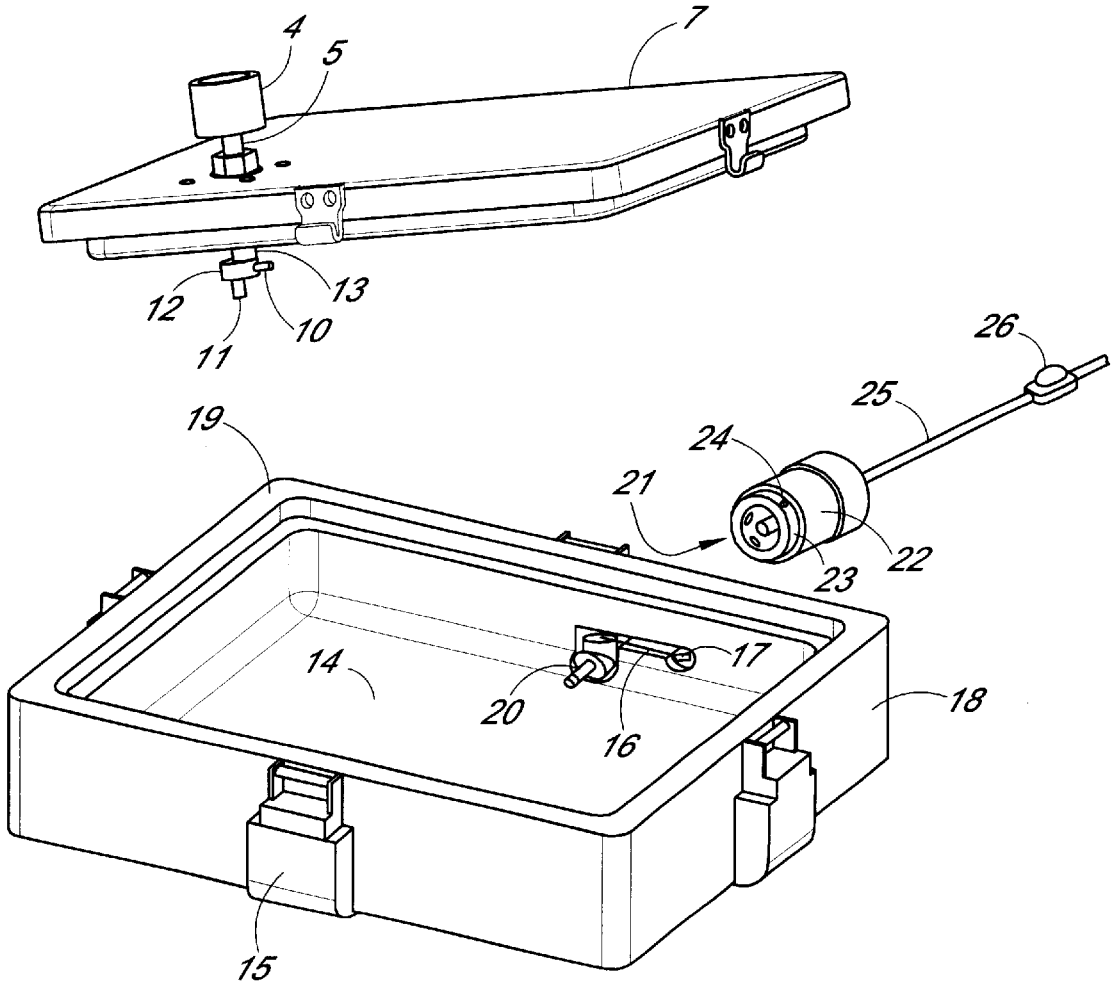
FIG. 1 is an isometric view of the housing system and audio coupling unit.
Figure 2:
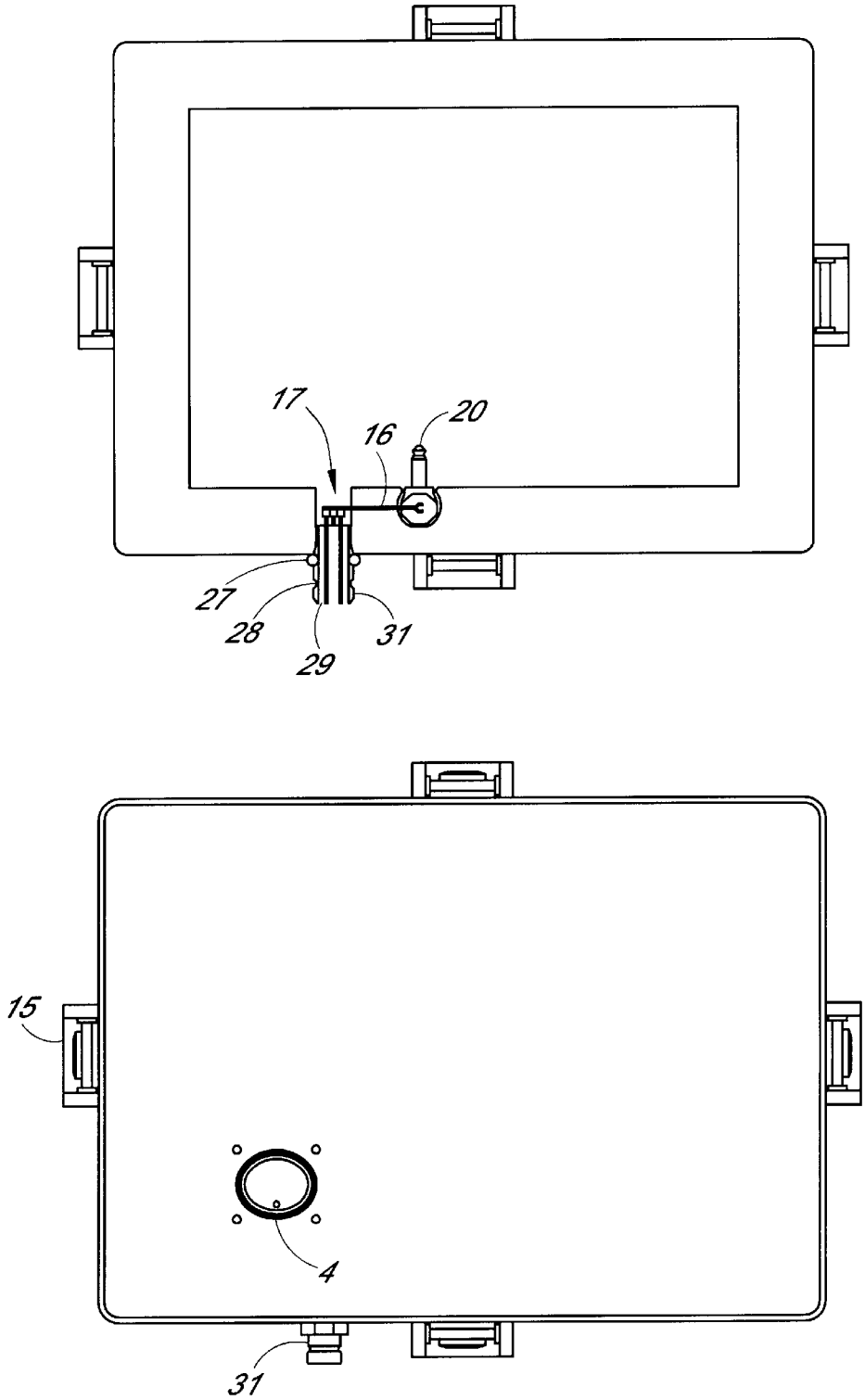
FIG. 2 is a cross section of the housing and top view of the lid attached to the housing body.

Corresponding reference characters indicate corresponding parts throughout the several views. The exemplification set out herein illustrates two preferred embodiments, TYPE I and TYPE II, described above of the invention and the variations of the speaker system coupling mechanisms, and such exemplification is not to be construed as limiting the scope of the invention in any manner.

DETAILED DESCRIPTION OF THE PREFERRED EMBODIMENT

The submersible housing system in FIG. 1 is a container unit with a bottom, front, back, left, and right side designed to snugly contain an electronic device. The lid 7 is made of a rigid material, preferably clear, that fits over the top 19 left, right, front, and back edges of the container. In the face down side of the lid is an o-ring 8 that sits in a recessed grove along the perimeter of the underside of the lid. The compression contact between the o-ring and the top edge 19 of the housing provides the hydrostatic seal.

Figure 3:
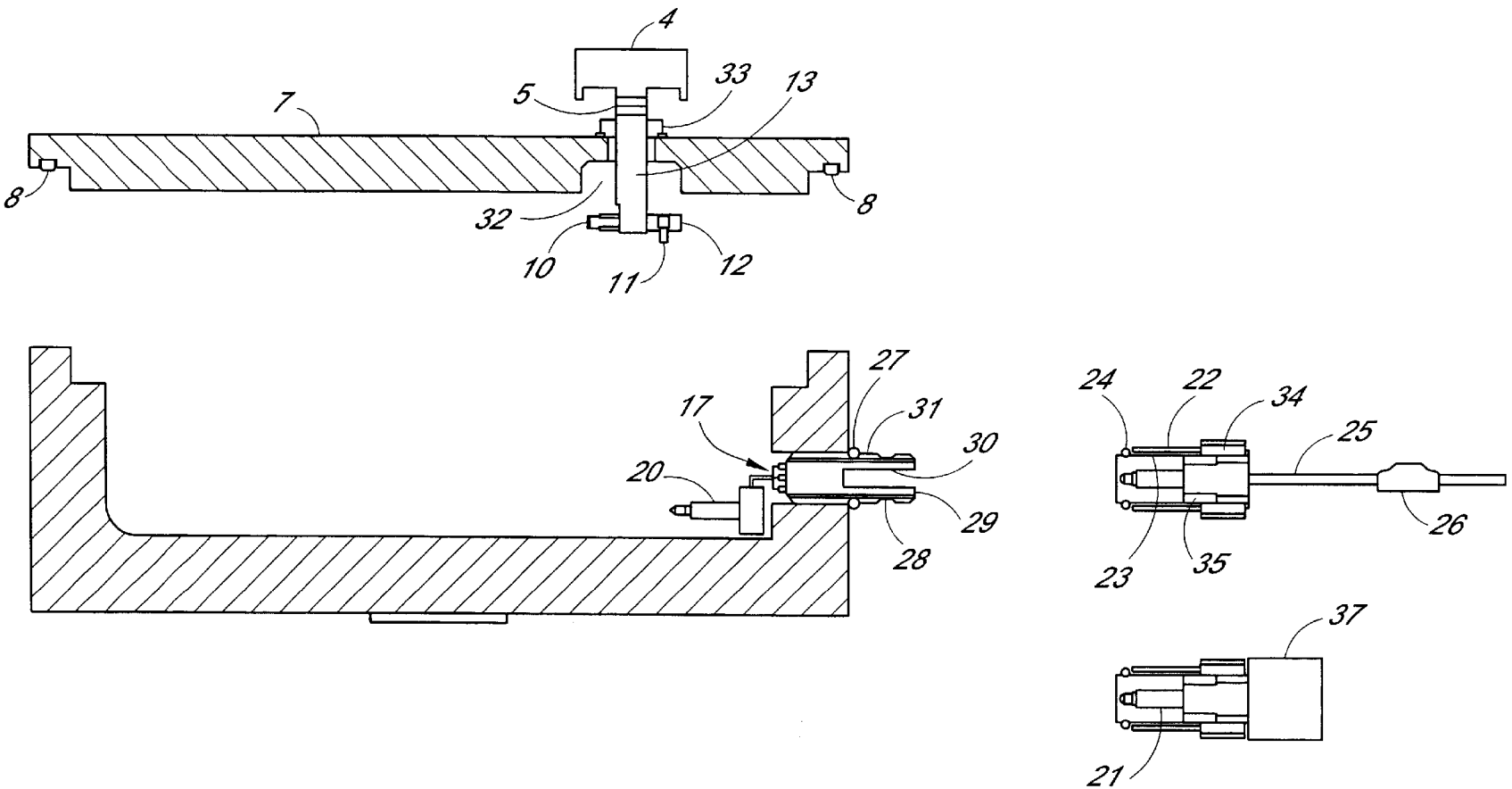
FIG. 3 is cross section of FIGS. 1–2.

The lid has two levels as seen in FIGS. 1 and 3. Level two is designed to sit above the device and within the step provided in the container box. This will serve the function of adding horizontal strength to the housing and ensuring the prevention of a change in structure, which could result in a break of the hydrostatic seal, causing a leak. The first level is designed to contain an o-ring 8 in a recessed grove located between level one and the outer perimeter of the lid on the face down side. This o-ring 8 will be compressed on the perimeter of the top 19 of the container box to make a seal that is not only water resistant and waterproof, but also submersible to one or more pressures absolute while maintaining a hydrostatic seal against the environment. In order to secure the seal, the preferred embodiment will contain buckles 15 located on the peripheral exterior that will snap and lock the lid to the container. Such a buckle is manufactured by Nelson and is specially designed to lock when snapped shut preventing accidental unsnapping of the buckle that could potentially release the lid from the container breaking the hydrostatic seal. To unlock the device, two fingers are required: one to hold down the safety latch down while the second finger lifts the buckle.

A control knob 4 allows the user's to rotate an internal pressing device 11 so that a push button controller on the entertainment device can be activated externally while maintaining a hydrostatic seal against the environment. In an arbitrarily located position, relevant to the device sitting in the housing system, a control knob 4 made of a rigid material is placed through the lid 7 to allow exterior manipulation of the activation devices of the device. The control knob system is a comprised of a camshaft 13 surrounded by an o-ring housing 33 with a knob 4 on the exterior end, and a hex screw 10 caddy 12 and a presser 11, on the interior end. Thus, the presser structure 11 can be positioned anywhere along a 360 degree location on a horizontal axis by turning the knob 4 in the rotation chamber 32. The vertical position can be manipulated from the exterior by pressing the knob 4. In order to deal with the constant inward pressure, an exterior spring 5 pushes the knob back up to its original position. The result is a vertical and horizontal movement control of the caddy 12 and presser 11 used to control the interior device.

A stereo jack 20 plugs into the device so that the sound is transmitted from the device through a short flexible slack of cable 16. This will allow the electronic device to be easily connected, and inserted in the housing. This also allows the flexibility and adaptability function by using any type of device that is equipped with an audio jack. The wires from the stereo jack 20 make a connection 17 to a stereo jack adapter 30 located in the body wall 18 of the housing. This stereo jack adapter sits within the bore of a male hydraulic nipple 31 that lies flush with exterior end. There is an o-ring 27 between the body wall 18 and the male hydraulic nipple 31 that establishes a hydrostatic seal. This entire stereo jack adapter is designed to screw into the body wall and serves as a means of providing an easily replaceable, and fixed, pressure resistant audio jack adapter that can withstand one or more pressure absolute while maintaining a hydrostatic seal against the water environment, and, that plugs into a stereo device.

Coupling to the male hydraulic nipple 31 is the female hydraulic coupler FIG. 3 that has a built-in stereo jack 21. The female coupler is snapped over the male hydraulic nipple with a locking bearing 24 mechanism to establish a hydrostatic audio connection by means of a locking mechanism to the male coupler. This operates by sliding the outer shell 22 away from the port. This action allows the internal ball bearing 24 to slide out from the interior through the holes in the interior shell when inserting the male nipple 31 into the female coupler 21. As such, a secure connection is established. This occurs because the jack 21 that is inside the female coupler fits into the adapter 30 within the male coupler. Releasing the sliding shell 22 causes the internal spring 34 to push the outer shell 22 towards the port whereby the ball bearings 24 are once again pushed through the holes in the interior shell 23. The ball bearing 24 then fit into the groove 28 of the male coupler, preventing the two units from separating.

A hydrostatic seal is established by this juncture. The female coupler contains an o-ring 35 inside to provide a hydrostatic seal capable of withstanding one or more pressure absolute. The flat, front edge, of the male coupler makes contact with the o-ring. When the sliding shell 22 is released and the ball bearings fit in the groove 28, it initiates a small degree of compression on the juncture that drives the front edge of the male couple deeper into the internal o-ring 35 of the female couple. Thus, a hydrostatic seal is established that provides for a pressure resistant and waterproof juncture between the male and female adapters. This unit has the benefit that it can rotate around the axis without breaking the seal. In addition, this unit will allow the user to completely disengage and reestablish the connection underwater without flooding and damaging the interior of the housing because the male and female hydraulic couplers are completely internally sealed components. The male coupler contains a solid flexible filling 29 such as silicone or rubber, which prevents water from entering. The female coupler contains a thick o-ring 35 internally. This is important because if for any reason the cable pulls apart from the housing then the housing unit will not flood and destroy the electronic device.

In the "TYPE I" embodiment, the submersible pressure resistant cables 25 from the female stereo jack runs up to an exterior volume control 26 comprised of a variable resistor. The audio cable is made of material capable of transmitting audio data. This material can range from copper to fiber optics. This cable is covered with a non-permeable flexible membrane. Between the housing coupling unit and the speakers, in the cable, is positioned a variable resistor 26 in the cable for adjusting the volume of the earphones. The resistor circuitry will allow for modulation of the audio level to the speakers. Furthermore, the circuitry is within a permanently sealed housing that can withstand one, or more, absolute pressures.

The headset utilizes a frame 39 to which the speaker arm 44 is mounted. The frame is rigid and comprises a swivel 43 and a hollow chamber through which a mask strap feeds. This will allow for horizontal adjustment by sliding, and vertical adjustment by rotating the arm of the swivel. Thus, a user can position the speaker to personal and custom coordinates. The speaker arm 44 is a concave frame with speakers 52, 54, 55 mounted on the end 45. Angular adjustments allow the user to specifically orient the speakers in three-dimensional space to suit personal coordinates. It is intended for the user to position the speakers near the ears, directing the sound waves into the ear canal but not restricting the canal passageways. This is important to allow the diver the ability to equalize pressure of the sinus and ear canals with the ambient pressure of the environment. The wire cable runs through the membrane 46 of the securely sealed speaker housing to the piezoelectric 52, 54, 55 ceramic speaker elements with a 290 Hz to 10 kHz frequency range. This range is important in the design of the speakers because they work to correct for aquatic dampening effect. The three speakers are designed to operate at fidelity levels heard out of water, while underwater. Due to the dampening effect of water, the frequency ranges for the dampened wavelengths are compensated. Thus, out of water, the speakers do not sound normal. However being underwater, they provide fidelity without loss of clarity. A rigid yet nondense diaphragm 51 comprising of such materials as fiber-reinforced epoxy, polyester, ABS resin or the like, covers the speakers covers the outside. This will allow the sound to travel through the diagram with the least resistance and serve to move the diaphragm for increased sound fidelity. It is a permanent structure and should be sealed and fixed.

Figure 4:
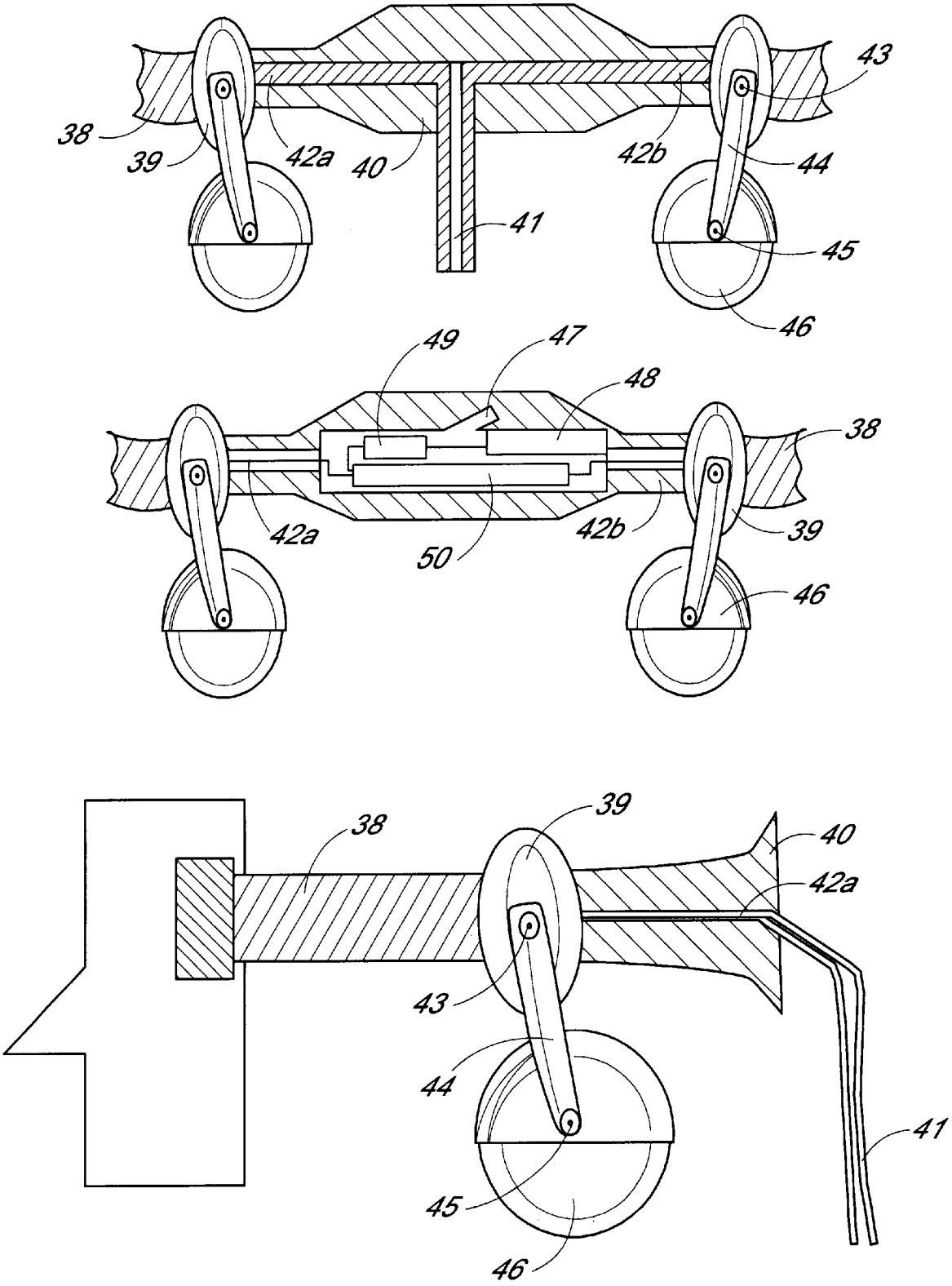
FIG. 4 is a plan and side view of the head mounted speaker system assembly, viewing side with a scuba mask and strap.

In the "TYPE III" embodiment shown in FIG. 4, a wireless receiver system is equipped into the mask strap system. A wireless receiver 49 is connected to an analog converter 50 which then send the audio signel to the speakers via cables 42*a*, 42*b*. A switch 47 allows the user to control the power. The switch is covered with a flexible nonpermable membrane that can toggle to an on or off position. A battery 48 provides the power to wireless receiver system. The battery is secured from the environment within the receiver system and can be easily replaced by unscrewing a side port lid and sliding the battery out for replacement.

Figure 5:
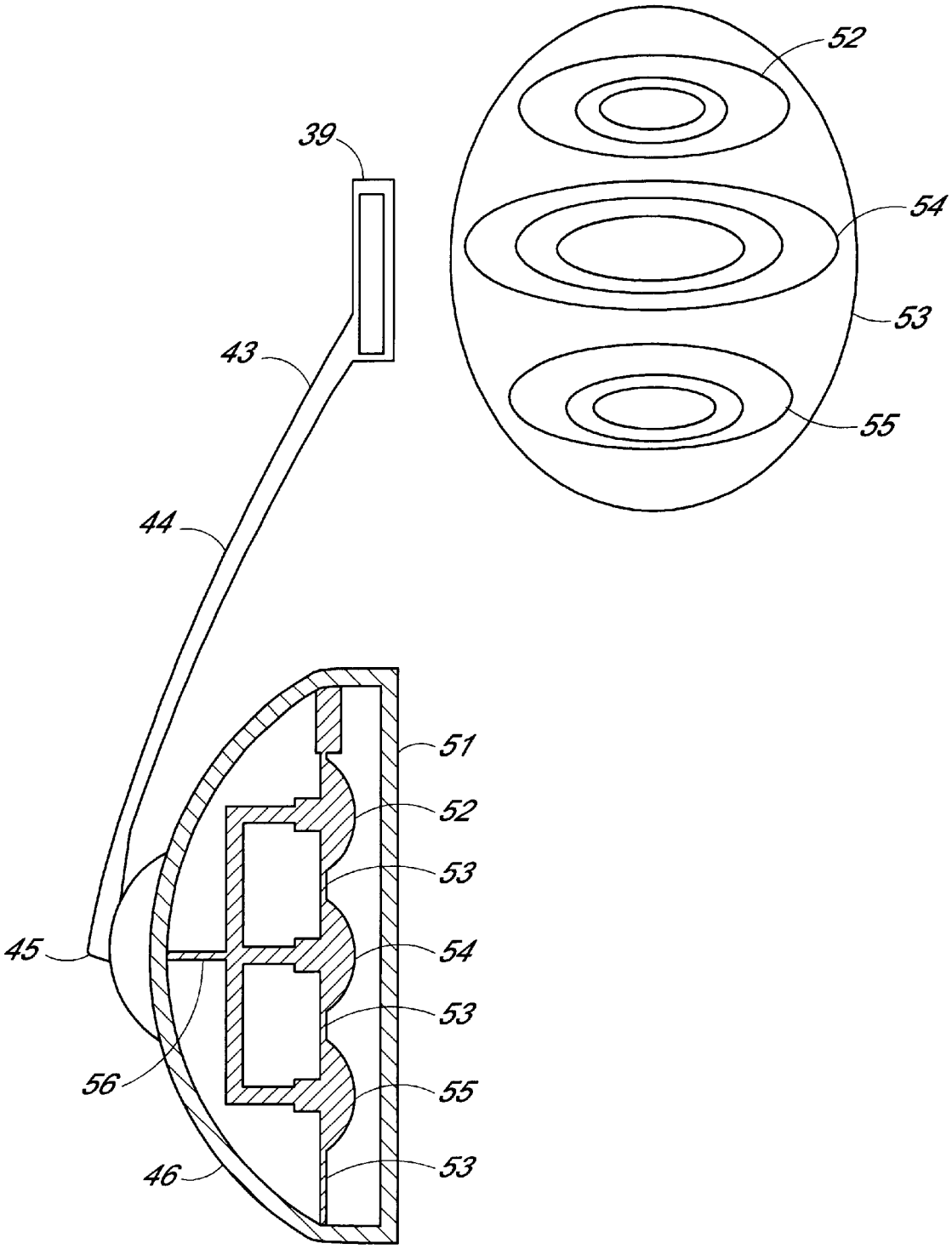
FIG. 5 is a cross section and front view of the speaker system assembly.

The interior circuitry 56 of the speakers 52, 54, 55 is coated with a nonconductive, marine grade material to prevent corrosion and damage. By using, piezoelectric, bone conduction, or ultrasonic mechanisms, high fidelity is accessible. The purpose of having several speakers is to be able to compensate for the fidelity loss caused by the water. In the embodiment represented in FIG. 5 the mid-range frequency speaker provides greater signal amplification than the low range 55 and high range 52 speakers. Thus, in effect, the audio fidelity heard underwater is maintained by over amplification of dampened frequency ranges. For those seeking to use a system that maintains the highest audio fidelity while underwater, this device provides enhancements over other systems.

This invention provides a simple and effective means of containing and submersing an entertainment device to one or more pressures absolute while maintaining a hydrostatic seal against the environment. The result is a submersible device that can produce audio waves underwater from an entertainment device. This invention has described how it overcomes deficiencies in prior art. An even further advancement can include integrating the disclosed invention with a dive computer. Thus, a housing can be explained that contains the components of a dive computer and the necessary components to interpret and send, via wireless or analog transmission, audio data all within a single portable unit.

Embodiments of the present invention have been shown and described with a degree of particularity to enable a complete and full understanding of those embodiments. It should be understood, however, that the present invention involves inventive concepts defined in the appended claims, and these inventive concepts are not intended to be limited by the detailed description herein beyond that required by the prior art and as the claims are allowed. The apparatus for a scuba diving audio system housing of the present invention can take other forms such as "TYPE III" and "TYPE IV"and is susceptible to various changes in detail of structure without departing from the principles of this invention.

What is claimed is:

1. A pressure resistant, hydrostatically sealed, portable housing and external speaker system for a personal audio device for use by scuba divers while underwater and exposed to ambient pressure, comprising of:

a rigid unified container and lid, said housing having an opening for receiving the device, means for sealing said opening with lid and secure latching mechanisms, means for externally controlling the internal device, means for connecting the device to an audio jack in the housing, means for connecting an electrical audio cable to said housing audio jack with a variable resistor in the cable, and stereo earphones operatively attached to the other end of said cable, said earphones each including a rigid, sealed housing, containing the operative components of the earphone including several piezoelectric speakers operating at variable frequencies to compensate for the dampening effect of audio in water.

2. The system of claim 1 in which the rigid housing is made of a lightweight, non-flexible rigid material having a bottom, front, rear, right side, and left side which define an interior chamber of a single unified structure that can snuggly accommodate an electronic audio device.

3. The system of claim 2, wherein a rigid lid latches onto the housing and seals the housing unit along the top perimeter of the housing, wherein the seal between the lid and the housing comprises a compression based o-ring technology.

4. The system of claim 3, further comprising:

control knobs for externally manipulating the internal device, wherein the control knobs are located on the housing;

a plurality of camshafts surrounded by compression sealing mechanisms for preventing water from influxing into the interior of the housing; and a spring mechanism surrounding the external portion of the camshafts between the lid and the control knobs for maintaining an outward force on the control knobs;

wherein the lid has a space provided in the bottom side for allowing free horizontal rotation and vertical alignment of the internal device.

5. The system of claim 2, in which a fixed stereo jack adapter is constructed into the body of the housing and plugs into the internal device.

6. The system of claim 5, in which an exterior coupling device is used to join and seal the stereo jack adapter to the audio cable.

7. The system of claim 6, wherein the coupling device comprises a wireless transmitter.

8. The system of claim 7, wherein the wireless transmitter is adapted to be rotated around its axis to modulate amplification of the sound from the internal device.

9. The system of claim 6 in which an external, pressure resistant, waterproof, variable resistor is used for adjusting the volume of the sound produced by the internal device, wherein the resistor is connected to the exterior coupling.

10. The system of claim 1 in which a waterproof earphone apparatus, comprising:

Speakers for resonating sound in response to electrical impulses generated by the device, including flexible waterproof wire leads connected to said speaker for conducting electrical impulses to the speaker, rigid housing for containing electrical circuitry and speakers, swivel mechanism for rotating the speaker housing unit around in a full 360 capacity, hollow frame to which the speaker housing arms are attached allowing a mask strap to feed through, a flexible cushioning material for feeding a mask strap through and offering greater support for mask strap speaker system.

11. The system of claim 10, further comprising components which attach a wireless receiver to the mask strap.

12. The system of claim 1 in which the entire system is capable of maintaining a hydrostatic and waterproof seal in highly pressurized aquatic environments.

13. A personal audio system for use by a scuba diver comprising:

a waterproof housing adapted to withstand the pressure experienced by said scuba diver;

a device for converting sound or data recorded on a medium to audio signals, said device being positioned inside said waterproof housing; and components for transferring audio signals from said audio device to the ears of said scuba diver.

14. An audio system for underwater use comprising:

a housing having a rigid container and a lid adapted to fit the container, wherein the container has an opening for receiving an audio device;

components which provide a waterproof seal between the container and the lid in the area of the opening;

components which secure the lid to the container;

components which externally control the device;

components which connect the device to an audio jack, wherein in the audio jack is attached to the housing;

components which connect an audio communication link to the audio jack; and earphones connected to the communication link, wherein the operative components of the earphone are contained within a rigid, sealed enclosure.

* * * * *